US010231553B1

(12) United States Patent
Gregory et al.

(10) Patent No.: US 10,231,553 B1
(45) Date of Patent: Mar. 19, 2019

(54) CONVERTIBLE BED

(71) Applicant: Gregory Furniture Designs, High Point, NC (US)

(72) Inventors: Scott Gregory, High Point, NC (US); Roberto Farinhaque, Sao Bento do Sul. SC (BR); Claudio Farinhaque, Sao Bento do Sul. SC (BR)

(73) Assignees: Scott Gregory and Associates, LLC, High Point, NC (US); NASA Industrial Imp.E. Ex. De Manufacturados LTDA, Santa Catarina (BR)

( * ) Notice: Subject to any disclaimer, the term of this patent is extended or adjusted under 35 U.S.C. 154(b) by 0 days.

(21) Appl. No.: 15/704,862

(22) Filed: Sep. 14, 2017

Related U.S. Application Data

(60) Provisional application No. 62/395,082, filed on Sep. 15, 2016.

(51) Int. Cl.

| | |
|---|---|
| ***A47C 17/22*** | (2006.01) |
| ***A47C 17/32*** | (2006.01) |
| ***A47C 19/02*** | (2006.01) |
| ***A47C 19/20*** | (2006.01) |

(52) U.S. Cl.
CPC ..... *A47C 17/22* (2013.01); *A47C 19/025* (2013.01); *A47C 19/205* (2013.01); *A47C 17/32* (2013.01)

(58) Field of Classification Search
CPC ..... A47C 17/04; A47C 17/13; A47C 17/132; A47C 17/22; A47C 17/225; A47C 17/32
USPC ..... 5/14, 17, 18.1, 12.1, 12.2
See application file for complete search history.

(56) References Cited

U.S. PATENT DOCUMENTS

| | | | | | |
|---|---|---|---|---|---|
| 53,188 | A * | 3/1866 | Rose | A47C 17/32 | 5/18.1 |
| 117,775 | A * | 8/1871 | Hart et al. | A47C 17/32 | 5/18.1 |
| 361,189 | A * | 4/1887 | Smither | A47D 7/04 | 5/96 |
| 479,071 | A * | 7/1892 | Holstein | A47C 17/16 | 5/12.1 |
| 1,721,647 | A * | 7/1929 | Stoltenberg | A47C 17/132 | 5/18.1 |
| 4,204,287 | A | 5/1980 | Lane et al. | 5/18 | |

(Continued)

FOREIGN PATENT DOCUMENTS

CN 203563958 4/2014

OTHER PUBLICATIONS

Hermes-daybed AA-135360 Ikea p. 1-24.

*Primary Examiner* — Robert G Santos
(74) *Attorney, Agent, or Firm* — MacCord Mason PLLC

(57) ABSTRACT

A bed convertible between a sofa configuration and a bed configuration. The bed includes a stationary bed support assembly having a stationary bed frame, a back rail, a front rail, and a plurality of slats adapted to support a mattress and a movable bed support assembly having a movable bed frame, a back rail, a front rail and a plurality of slats adapted to support a mattress. In one embodiment, a storage compartment is located underneath the stationary bed support assembly and the movable bed support assembly. Also, a backrest may be attached to the back rail of the stationary bed support assembly, whereby the backrest is adapted to support a user's back when the bed is in the sofa configuration.

38 Claims, 17 Drawing Sheets

(56) References Cited

U.S. PATENT DOCUMENTS 4,343,054 A * 8/1982 Kane ..... A47C 17/16 5/18.1
4,803,742 A 2/1989 Rasnick et al. ..... 5/18
5,101,524 A 4/1992 Brandschain ..... 5/17
5,392,475 A * 2/1995 McCall ..... A47C 19/04 5/18.1
6,108,844 A * 8/2000 Kraft ..... A47C 17/22 5/710
6,161,231 A * 12/2000 Kraft ..... A47C 17/22 5/12.1
6,434,766 B1 * 8/2002 Beddawi ..... A47B 83/00 5/12.1
7,086,108 B1 * 8/2006 Litvak ..... A47C 21/046 5/200.1
7,310,838 B2 * 12/2007 Goldstein ..... A47C 17/14 5/12.2
7,685,655 B1 * 3/2010 Delmestri ..... A47C 17/17 5/18.1
8,375,483 B2 2/2013 Ray et al. ..... 5/18.1
8,651,579 B2 * 2/2014 Pettingill ..... A47C 23/06 297/452.49
9,078,527 B2 * 7/2015 Pettingill ..... A47C 23/06
2007/0000046 A1 * 1/2007 Goldstein ..... A47C 17/14 5/18.1
2007/0079437 A1 * 4/2007 Jefferis ..... A47C 17/136 5/18.1
2009/0025141 A1 * 1/2009 Ray ..... A47C 7/62 5/20
2012/0256467 A1 * 10/2012 Pettingill ..... A47C 23/06 297/452.55
2014/0157519 A1 * 6/2014 Pettingill ..... A47C 23/06 5/659
2014/0196208 A1 * 7/2014 Copeland ..... A47C 17/22 5/14
2015/0026881 A1 1/2015 Nault ..... 17/4

* cited by examiner

CONVERTIBLE BED

BACKGROUND OF THE INVENTIONS

(1) Field

The present inventions relates generally to beds and, more particularly, to a series of beds convertible from a sofa.

(2) Related Art

Daybeds and other convertible furniture are designed such that they provide advantages over and above conventional single function furniture. Such advantages may include but are not limited to the conservation of space and enhanced utility as furniture. Where traditional beds require a static amount of space and often precludes secondary use of said space, daybeds consume a smaller area of space while potentially matching the number of individuals it can serve in terms of functionality. Such utility can be especially advantageous in places such as residences and institutions that seek to maximize utility in areas where space is constrained. In conventional solutions for daybeds, these advantages come at the cost of stability and comfort afforded by a larger single framed bed.

Prior art includes a variety of designs that describe a daybed that can be used for seating and as a sleeping surface. Most of these embodiments consist of a frame to hold a single small mattress, usually but not limited to a twin size mattress. Many embodiments increase functionality by including a trundle, or a separate secondary frame, to hold a second small mattress, usually but not limited to a twin size mattress. Most embodiments of daybeds that include trundles are either configured independently, with the trundle moving freely and having an adjustable height or a height lower than the primary frame such that the secondary mattress can be hidden under the primary mattress, or combined in a lower section of the main frame such that the secondary mattress would pull out from under the primary mattress in a drawer-like configuration. While trundles or secondary frames with adjustable heights can be aligned with the primary frame to form a larger bed configuration, such embodiments may not match the stability and consistency provided by a larger bed with a single continuous frame.

Thus, there remains a need for a sofa capable of extending into a continuous king size bed while, at the same time, includes the capability of easily storing a mattress without requiring a separate storage unit/area.

SUMMARY OF THE INVENTIONS

The present inventions are directed to a bed convertible between a sofa configuration and a bed configuration. The bed includes a stationary bed support assembly having a stationary bed frame, a back rail, a front rail, and a plurality of slats adapted to support a mattress and a movable bed support assembly having a movable bed frame, a back rail, a front rail and a plurality of slats adapted to support a mattress. In one embodiment, a storage compartment is located underneath the stationary bed support assembly and the movable bed support assembly. Also, a backrest may be attached to the back rail of the stationary bed support assembly, whereby the backrest is adapted to support a user's back when the bed is in the sofa configuration.

The slats of the movable bed support assembly overlap the front rail of the stationary bed support assembly and interlock with the slats of the stationary bed support assembly, whereby the bed is in the sofa configuration when the front rail of the movable bed support assembly abuts the front rail of the stationary bed support assembly and the bed is in the bed configuration when the back rail of the movable bed support assembly abuts the front rail of the stationary bed support assembly.

The front rail of the stationary bed support assembly may be scalloped along its top edge for enabling the slats of the movable bed support assembly to slide forward and backward as the bed switches between configurations.

The bed may further includes a stop adapted to prevent the movable bed support assembly from extending past the stationary bed support assembly. In one embodiment, the front rail of the stationary bed support assembly forms the stop.

In one embodiment, the slats of the stationary bed support assembly and the slats of the movable bed support assembly are substantially the same length.

In one embodiment, the storage compartment includes a front, a pair of sides and a bottom. Also, the bed may further include at least one pair of wheels attached to the bottom of the storage compartment adapted to facilitate pulling the storage compartment from underneath the stationary bed support assembly. Also, the bed may further include handles on the front of the storage compartment to facilitate pulling the storage compartment from underneath the stationary bed support assembly.

In one embodiment, the storage compartment is adapted to receive and store a mattress. Also, the storage compartment may form a trundle bed when the storage compartment is pulled from underneath the bed and the bed is in the sofa configuration. Further, a first mattress that may be stored in the storage compartment is placed onto the movable bed support assembly when the bed is in the bed configuration. Also, a second mattress may be on the stationary bed support assembly when the bed is in the sofa configuration and forms a pair of mattresses with the first mattress on the movable bed support assembly when the bed is in the bed configuration. The pair of mattresses may be twin size and adapted to form a king size bed.

The bed may further include at least one side arm attached to the frame of the stationary bed support assembly, whereby the side arm is adapted to support a user's arm when the bed is in the sofa configuration and whereby the side arm is adapted as a headboard when the bed is in the bed configuration.

In one embodiment, the bed includes a pair of side arms attached to the frame of the stationary bed support assembly, whereby the pair of side arms are adapted to support users' arms when the bed is in the sofa configuration and whereby the pair of side arms are adapted as a head board and footboard when the bed is in the bed configuration.

The bed may further include at least one pair of legs attached to the front portion of the frame of the stationary bed support assembly adapted to elevate and support the stationary bed frame. In one embodiment, the bed further includes at least one pair of legs attached to the front portion of the frame of the movable bed support assembly adapted to elevate and support the movable bed frame.

In one embodiment, the bed further includes two additional pairs of legs, one pair of legs attached to the back portion of the frame of the stationary bed support assembly adapted to elevate and support the stationary bed frame and a second pair of legs attached to the back portion of the frame of the movable bed support assembly adapted to elevate and support the movable bed frame.

In one embodiment, the bed further includes a mattress positioned on top of the stationary bed support assembly adapted to provide a surface for a user to sit and lay on. The mattress may be a pair of two stacked mattresses adapted to be adjacently placed when the bed is in the bed configuration. In one embodiment, the pair of stacked mattresses are twin size and adapted to form a king size bed when adjacently placed.

Accordingly, one aspect of the present inventions is to provide a bed convertible between a sofa configuration and a bed configuration, the bed including (a) a stationary bed support assembly having a stationary bed frame, a back rail, a front rail, and a plurality of slats adapted to support a mattress; and (b) a movable bed support assembly having a movable bed frame, a back rail, a front rail and a plurality of slats adapted to support a mattress, wherein the slats of the movable bed support assembly overlap the front rail of the stationary bed support assembly and interlock with the slats of the stationary bed support assembly, whereby the bed is in the sofa configuration when the front rail of the movable bed support assembly abuts the front rail of the stationary bed support assembly and the bed is in the bed configuration when the back rail of the movable bed support assembly abuts the front rail of the stationary bed support assembly.

Another aspect of the present inventions is to provide a bed convertible between a sofa configuration and a bed configuration, the bed including (a) a stationary bed support assembly having a stationary bed frame, a back rail, a front rail, and a plurality of slats adapted to support a mattress; (b) a movable bed support assembly having a movable bed frame, a back rail, a front rail and a plurality of slats adapted to support a mattress; and (c) a storage compartment located underneath the stationary bed support assembly and the movable bed support assembly, wherein the slats of the movable bed support assembly overlap the front rail of the stationary bed support assembly and interlock with the slats of the stationary bed support assembly, whereby the bed is in the sofa configuration when the front rail of the movable bed support assembly abuts the front rail of the stationary bed support assembly and the bed is in the bed configuration when the back rail of the movable bed support assembly abuts the front rail of the stationary bed support assembly.

Still another aspect of the present inventions is to provide a bed convertible between a sofa configuration and a bed configuration, the bed including (a) a stationary bed support assembly having a stationary bed frame, a back rail, a front rail, and a plurality of slats adapted to support a mattress; (b) a movable bed support assembly having a movable bed frame, a back rail, a front rail and a plurality of slats adapted to support a mattress; (c) a storage compartment located underneath the stationary bed support assembly and the movable bed support assembly; and (d) a back rest attached to the back rail of the stationary bed support assembly, whereby the back rest is adapted to support a user's back when the bed is in the sofa configuration, wherein the slats of the movable bed support assembly overlap the front rail of the stationary bed support assembly and interlock with the slats of the stationary bed support assembly, whereby the bed is in the sofa configuration when the front rail of the movable bed support assembly abuts the front rail of the stationary bed support assembly and the bed is in the bed configuration when the back rail of the movable bed support assembly abuts the front rail of the stationary bed support assembly.

These and other aspects of the present inventions will become apparent to those skilled in the art after a reading of the following description of the preferred embodiment when considered with the drawings.

DESCRIPTION OF THE EMBODIMENTS

Figure 1A:
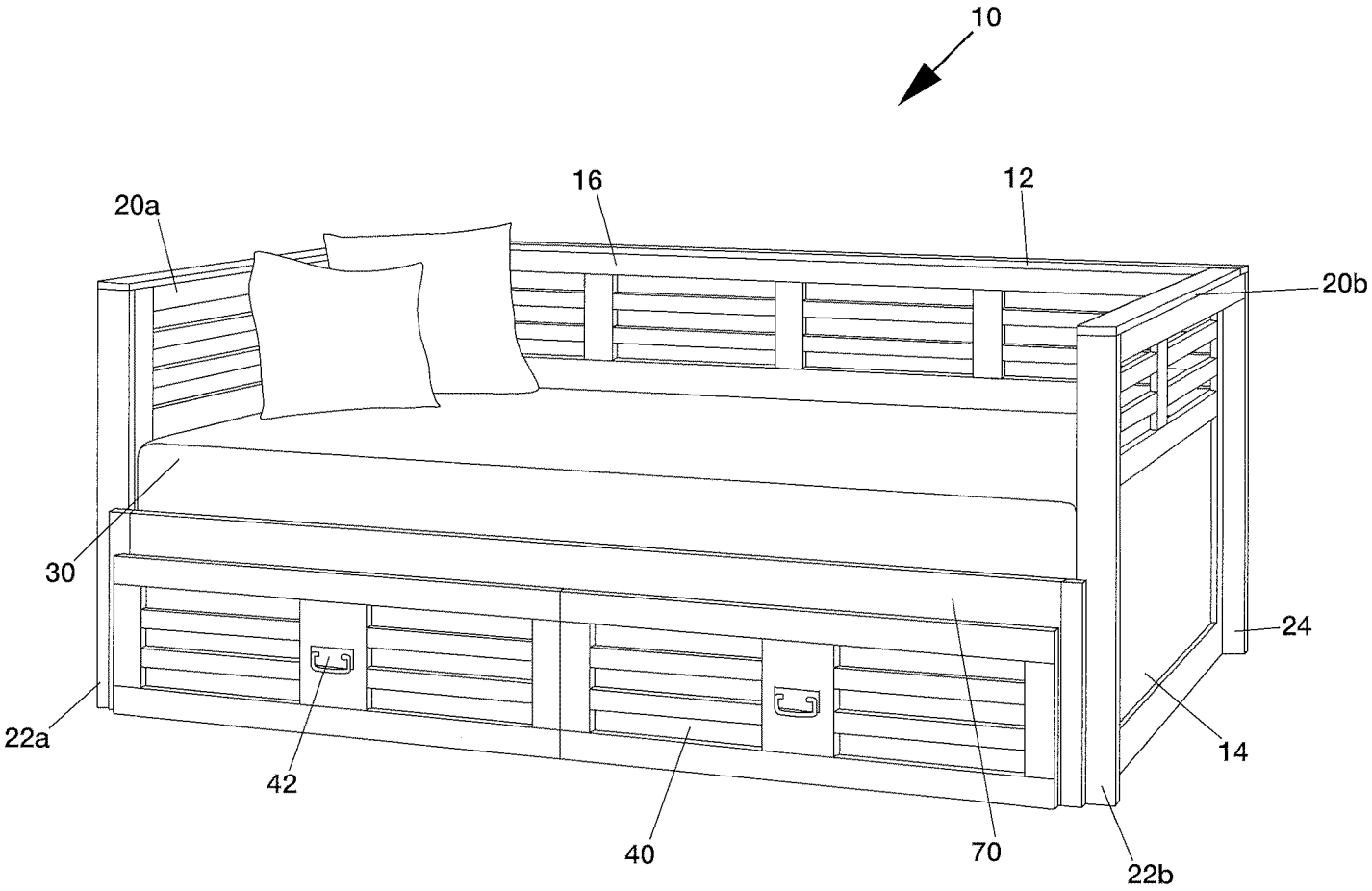
FIG. 1A is a perspective view of one embodiment of a bed in a closed configuration constructed according to the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the inventions and are not intended to limit the inventions thereto. As best seen in FIG. 1A, a bed, generally designated 10, is shown constructed according to the present inventions. The bed 10 is convertible between a sofa configuration and one or more bed configurations.

Figure 3:
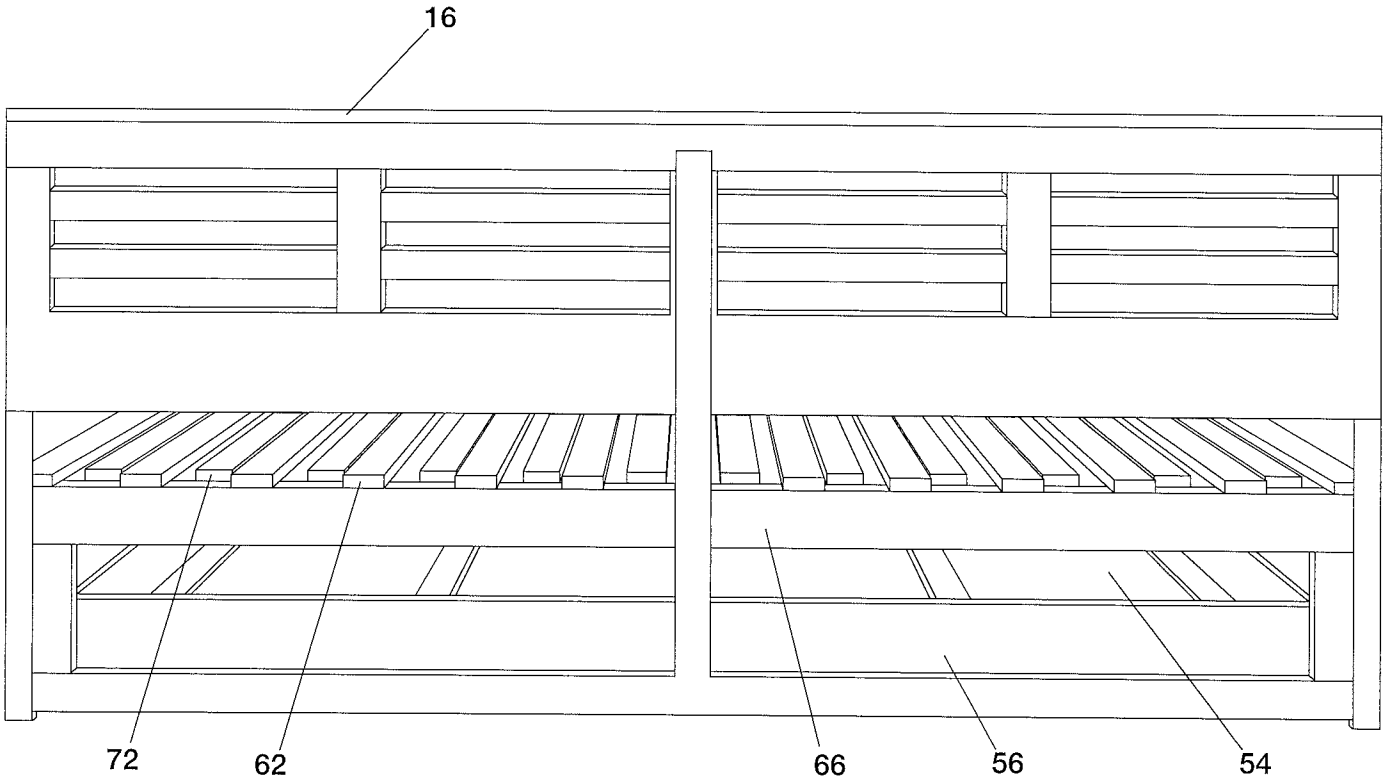
FIG. 3 is a back elevation view of the bed.

FIG. 1A depicts bed 10 in a sofa configuration. In the sofa configuration shown, bed 10 includes a stationary bed support assembly 12 having a stationary bed frame 14, a back rest 16 and a pair of side arms 20*a* and 20*b*. Back rest 16 may be attached to a portion of stationary bed support assembly 12 to support a user's back while bed 10 is in the sofa configuration. For example, as seen in FIG. 3, back rest 16 may be attached to a back rail 66 of stationary bed support assembly 12.

Side arms 16*a* and 16*b* attached to frame 14 and can be used to support a user's arm while bed 10 is in sofa configuration. While in a bed configuration, side arms 20*a* and 20*b* may also function as a head board and footboard, or vice versa. As seen in FIG. 1A, stationary bed support assembly 12 includes a pair of legs 22*a* and 22*b* attached to the front portion of frame 12 for elevation and support. A second pair of legs 24 may also be attached to the back of frame 12. In other embodiments, frame 12 may only include a first pair of legs 22 wherein the back portion of frame 12 is mounted onto a surface such as a wall.

Stationary bed support assembly 12 may support one or more cushions to provide a surface for a user to sit and lay on. For example, the cushion may comprise a mattress 30 positioned on top of stationary bed support assembly 12. In one embodiment, mattress 30 may comprise a pair of two stacked mattresses. Stationary bed support assembly 12 may support mattresses of various sizes. For instance, mattress 30 may be a twin size mattress.

A storage compartment 40 may also be included with bed 10. Storage compartment 40 may comprise one or more drawers underneath stationary bed support assembly 12. Storage compartment 40 may also include handles 42 on a front face to help pull the storage compartment 40 from underneath of stationary bed support assembly 12.

Figure 1B:
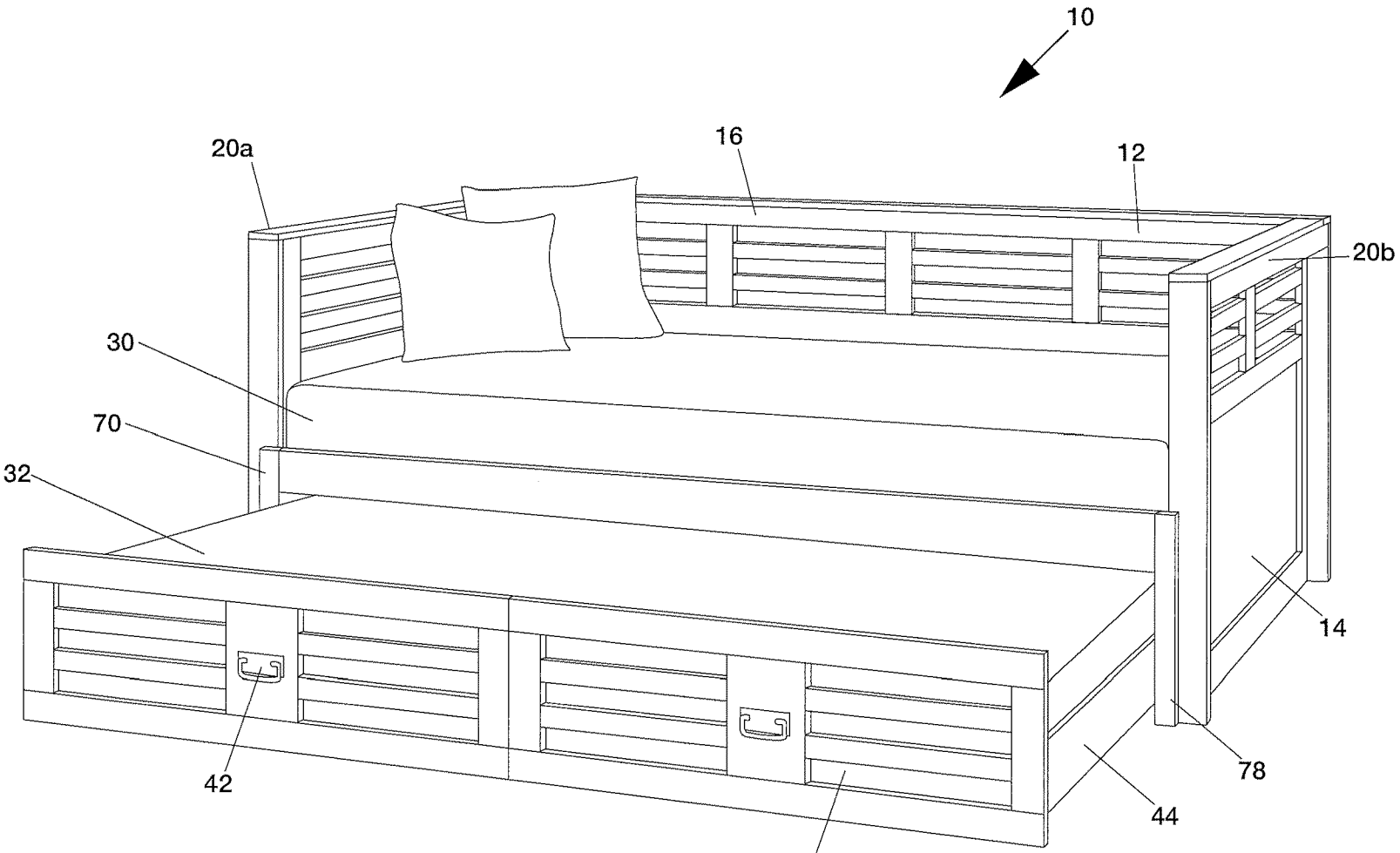
FIG. 1B is a perspective view of the bed shown in FIG. 1A with the trundle extended.
Figure 2A:
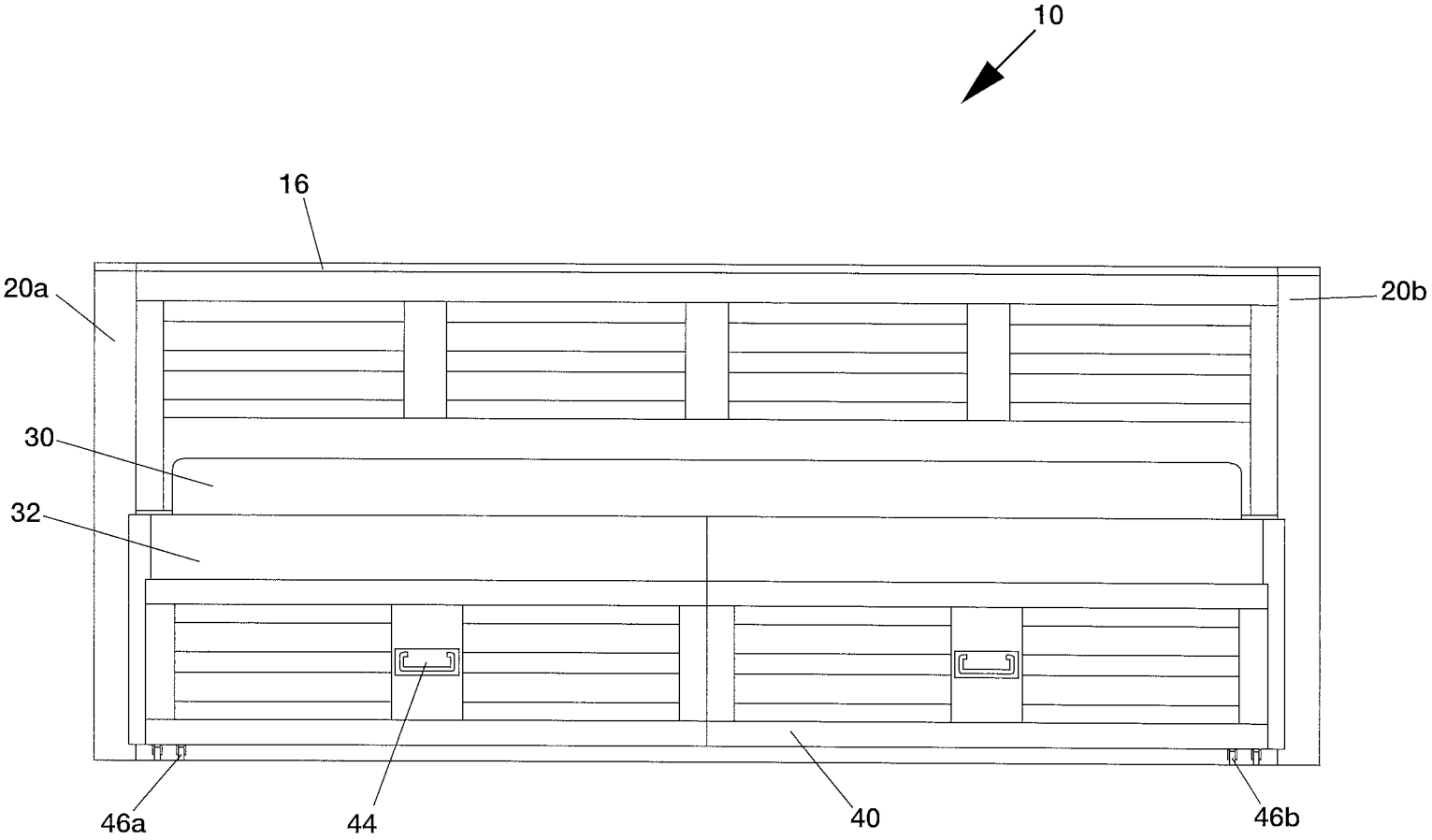
FIG. 2A is a front elevation view of the bed in a closed configuration with a mattress.
Figure 5A:
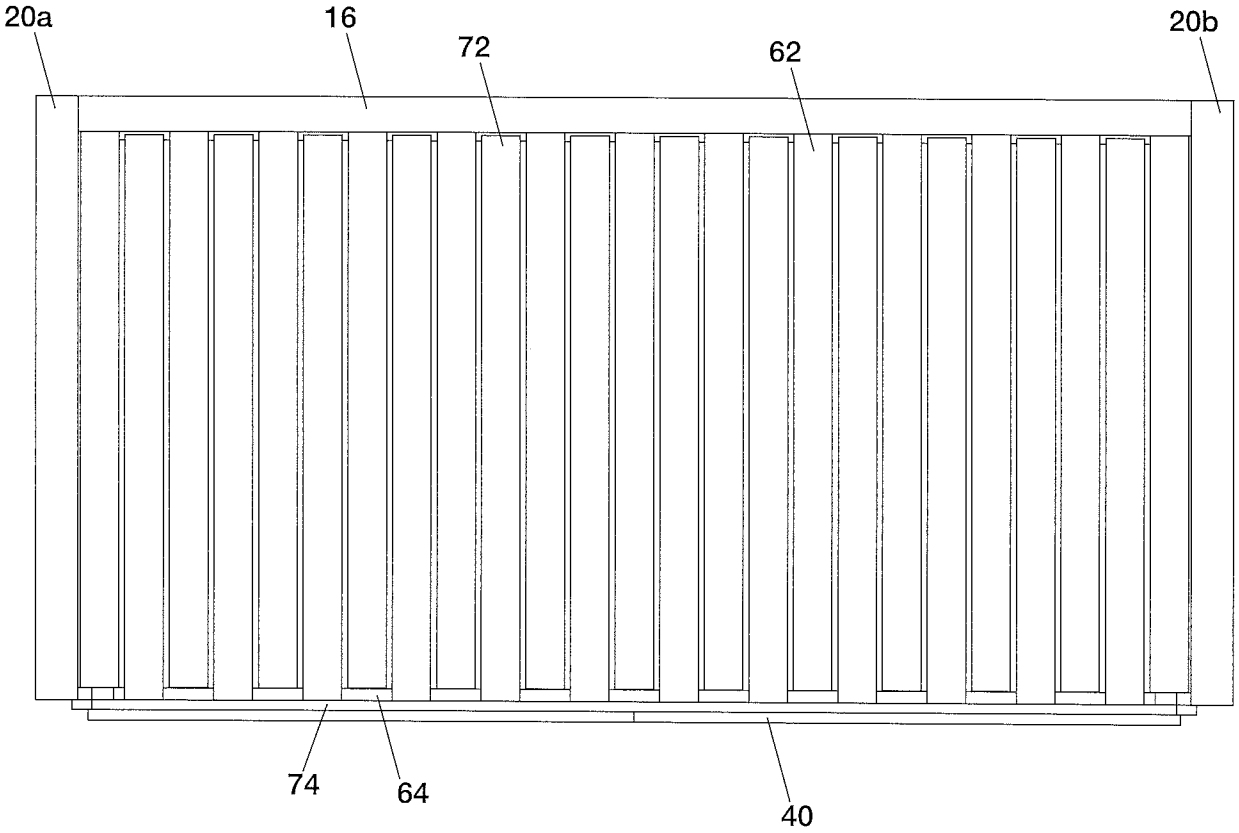
FIG. 5A is a top view of the bed in a closed configuration.
Figure 5B:
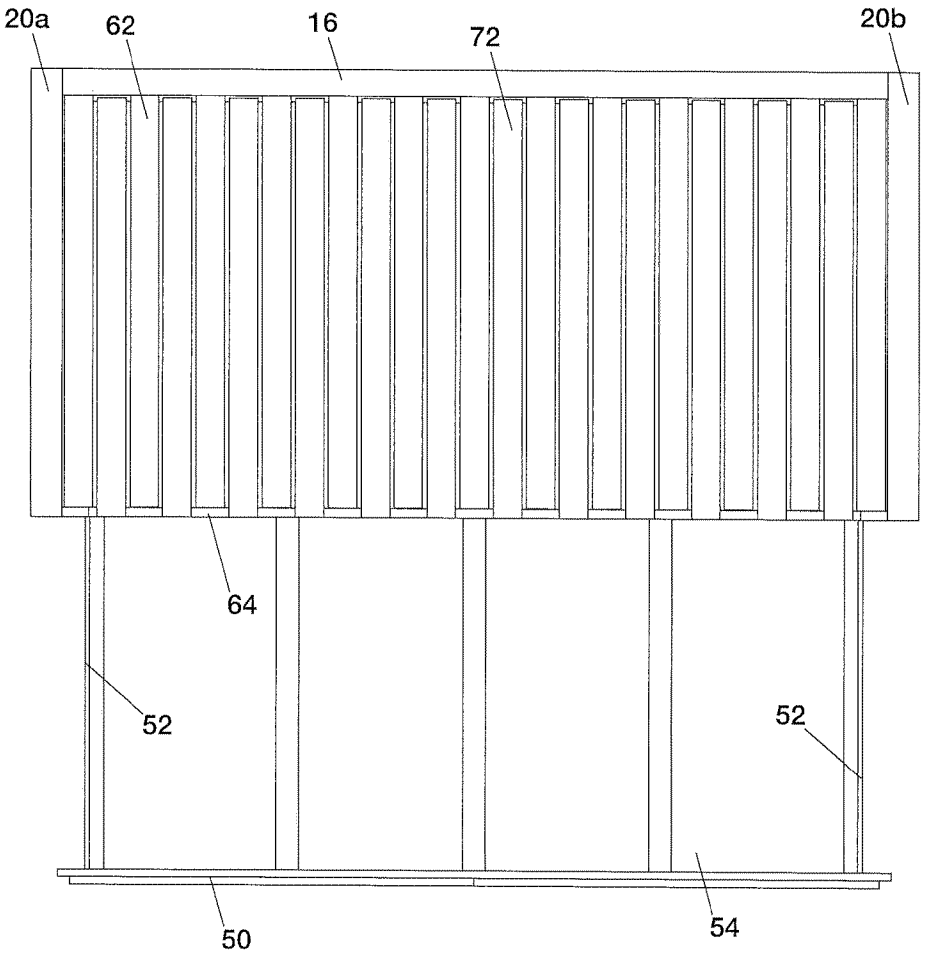
FIG. 5B is a top view of the bed shown in FIG. 5A with the trundle extended.

Turning to FIG. 1B, an embodiment of bed 10 is shown wherein storage compartment 40 forms a trundle 44. As seen in FIG. 2A, storage compartment 40 may further include one or more pairs of wheels 46 adapted to facilitate pulling trundle 44 from underneath stationary bed support assembly 12. Wheels 46 may also be included in other embodiments of storage compartment 40; for example, to facilitate pushing or pulling of drawers. As best seen in FIGS. 2C and 5B, storage compartment 40 includes a front 50, a pair of sides 52 and a bottom 54 that forms a recess for receiving mattress 32. A back piece 56 may also be included to help secure mattress 32 within the recess.

Figure 1C:
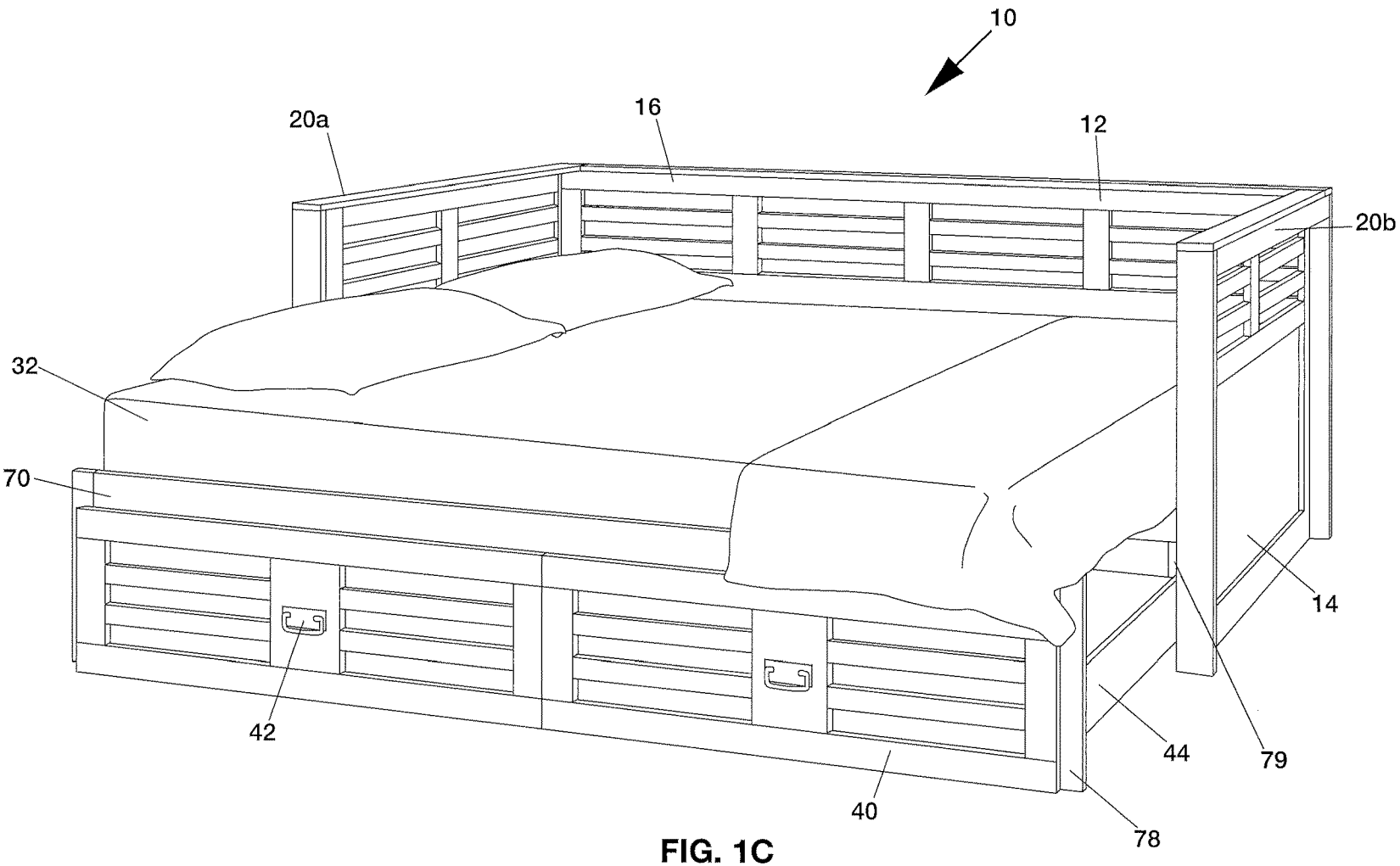
FIG. 1C is a perspective view of the bed shown in FIG. 1A with the trundle and slats extended forming a king size bed.

FIG. 1C depicts an embodiment of bed 10 shown in a bed configuration. In the bed configuration shown, bed 10 is extended out from its sofa configuration to a king size bed with mattress 32. In some embodiments, mattress 32 may be a non-stored mattress (for example, a pair of stacked mattresses). In other embodiments, mattress 32 may be stored in the storage compartment 40. Mattress 32 may be stored as is within storage compartment 40, or may form a trundle with storage compartment 40 (as seen in FIG. 1B). Mattresses 30 and 32 may vary in size. For example, mattresses 30 and 32 may each comprise a twin size mattress that form a king size bed when placed adjacently with each other.

Figure 2B:
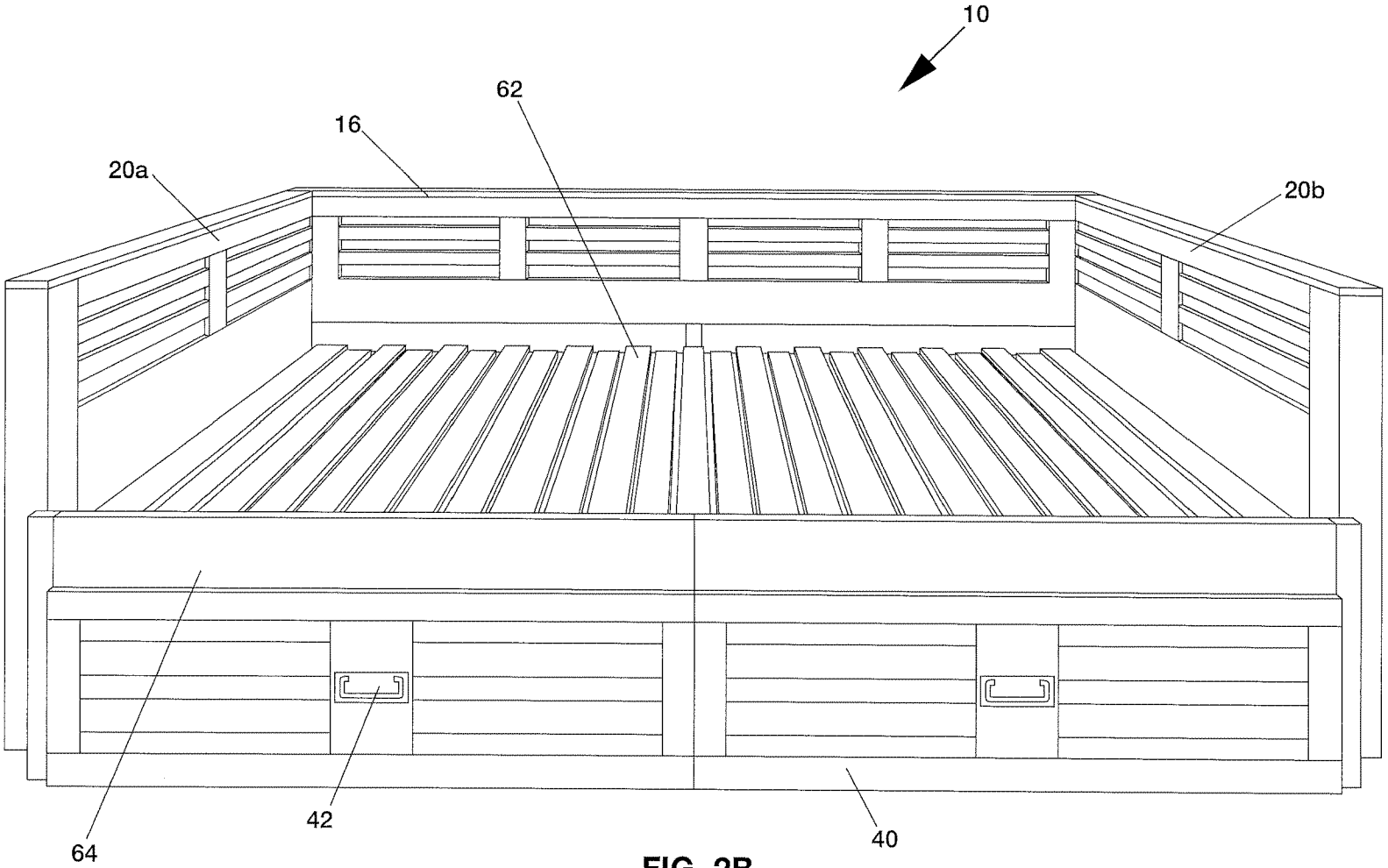
FIG. 2B is a front elevation view of the bed shown in FIG. 2A in a closed configuration without the mattress.
Figure 2C:
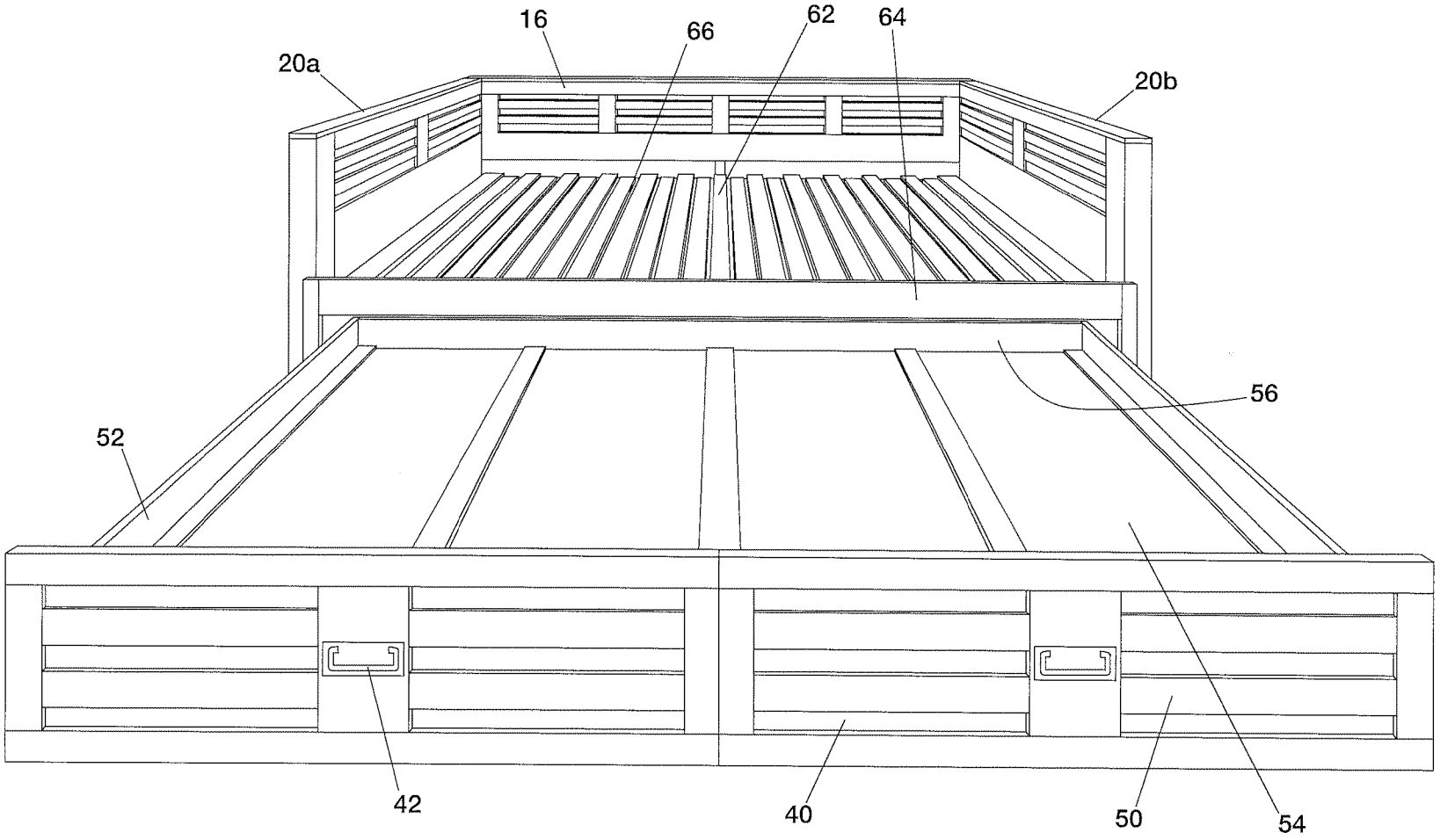
FIG. 2C is a front elevation view of the bed shown in FIG. 2A with the trundle extended.
Figure 2D:
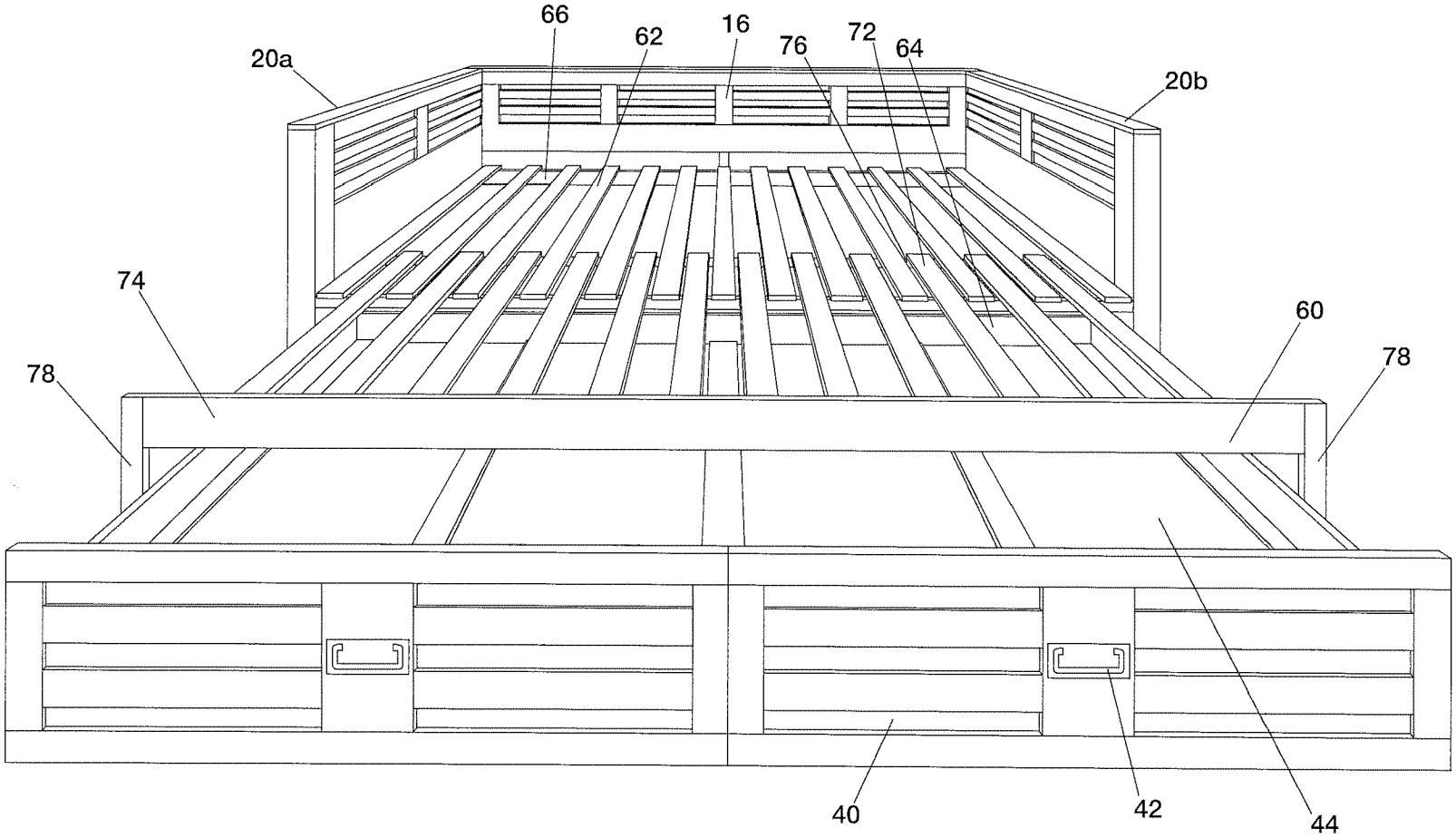
FIG. 2D is a front elevation view of the bed shown in FIG. 2A with the trundle and slats extended.

FIG. 2D provides a view of one embodiment of bed 10 transitioning from a sofa configuration to a bed configuration. Stationary bed support assembly 12 includes a plurality of slats 62 supported at one end by a front rail 64 and at an opposing end by a back rail 66. The plurality of slats 62 are adapted to support mattress 30. Movable bed support assembly 70 includes a plurality of slats 72 supported at one end by a front rail 74 and at an opposing end by a back rail 76. The plurality of slats 72 of movable bed support assembly 70 are positioned parallel with the plurality of slats 62 of stationary bed support assembly 12, and interlock with one another.

Figure 5C:
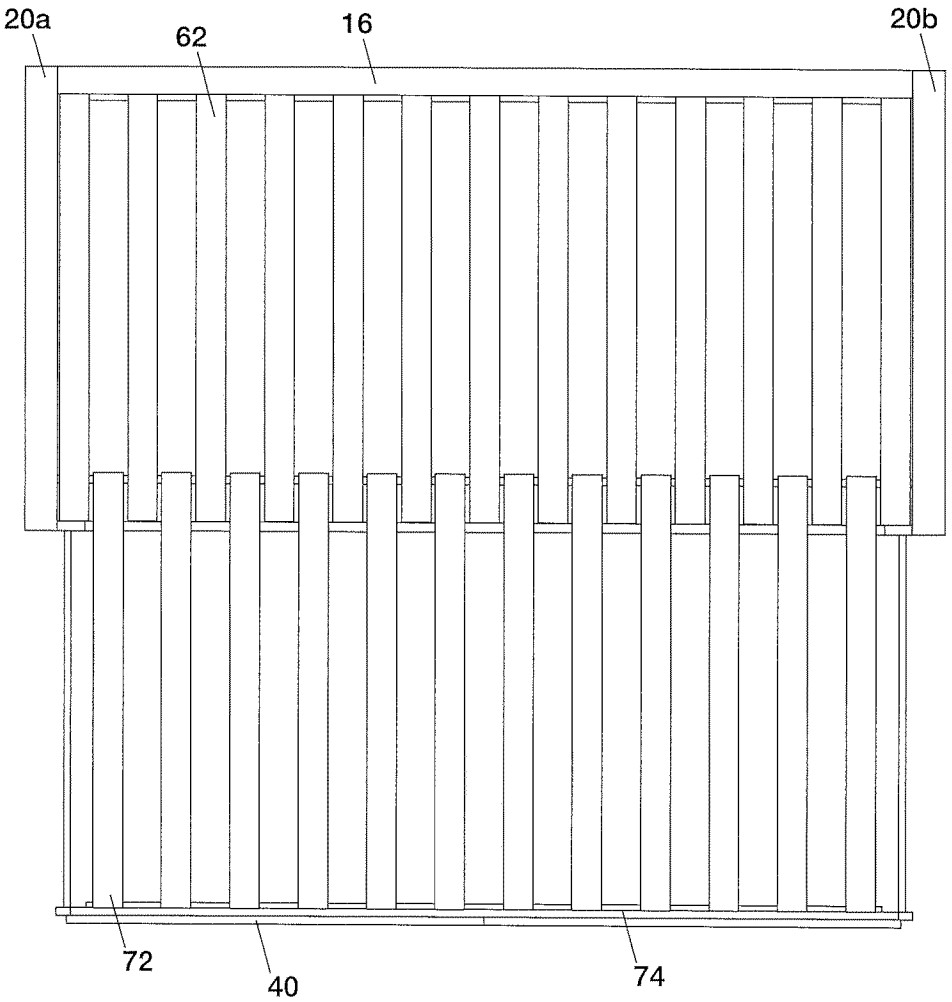
FIG. 5C is a top view of the bed shown in FIG. 5A with the slats extended to form a king size bed.

Slats 72 of movable bed support assembly 70 overlap with front rail 64 to provide additional structural support for slats 72. In the sofa configuration shown in FIGS. 2B and 5A, slats 62 and 72 both provide support for mattress 30. Conversely, as shown in FIGS. 2C and 5C wherein bed 10 is in a bed configuration with the movable bed support assembly 70 extended, slats 62 are adapted to support mattress 30 and slats 72 are adapted to support mattress 32. In the embodiment shown, slats 62 and slats 72 are substantially the same length. Other embodiments may have slats of varying length to accommodate different mattress sizes.

Movable bed support assembly 70 includes a pair of front legs 78 at its front rail 74 for elevation and support of mattress 32. In some embodiments, movable bed support assembly 70 may also include a pair of rear legs 79 attached to the back portion of its frame for additional elevation and support.

As shown in FIGS. 2B and 2C, the back rail 76 of movable bed support assembly 70 abuts the back rail 66 of stationary bed support assembly 12 while bed 10 in a sofa configuration. Similarly, front rail 74 of movable bed support assembly 70 abuts the front rail of stationary bed support assembly 12. The railings of stationary bed support assembly 12 may serve as a stop to prevent movable bed support assembly 12 from sliding past the backrest 16.

Returning to FIG. 2D, as bed 10 transitions from a sofa configuration to a bed configuration, the back rail 76 moves away from back rail 66 and toward front rail 64 as movable bed support assembly 70 extends away. In the embodiment shown, front rail 64 acts as a stop to prevent movable bed support assembly 70 from completely extending away from stationary bed support assembly 12, wherein front rail 64 abuts back rail 76 of movable bed support assembly 70. In other embodiments, an additional rail may be added to the stationary bed support assembly 12 to prevent movable bed support assembly 70 from extending past a certain distance. For example, an additional railing adapted as a stop may serve as a preset for the correct sizing to accommodate a second mattress 32.

Figure 6:
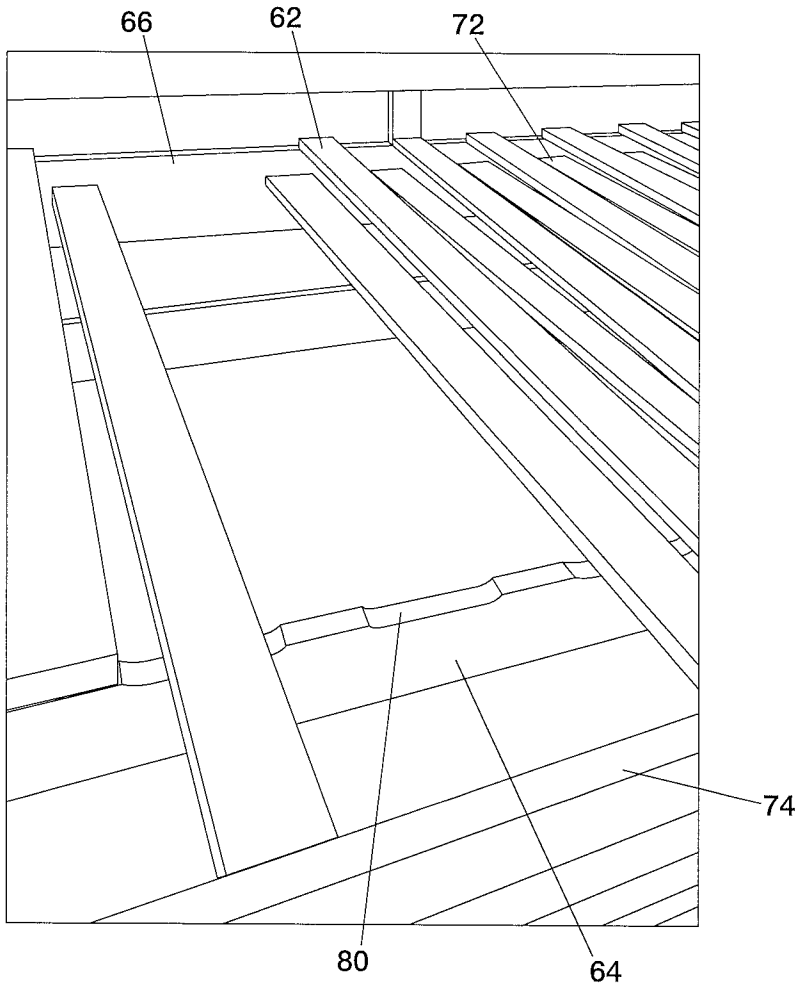
FIG. 6 is an enlarged view of the bed partially disassembled to show the front rail of the stationary bed support assembly being scalloped along its top edge to provide clearance for the slats when extended.

FIG. 6 shows an enlarged view of front rail 64. In the embodiment shown, front rail 64 is scalloped along its top edge. Scallops 80 are positioned directly below slats 72, and facilitates their movement across front rail 64. Addition of scallops 80 enables the movable bed support assembly 70 to smoothly slide forward and backward as bed 10 switches between configurations.

Figure 4A:
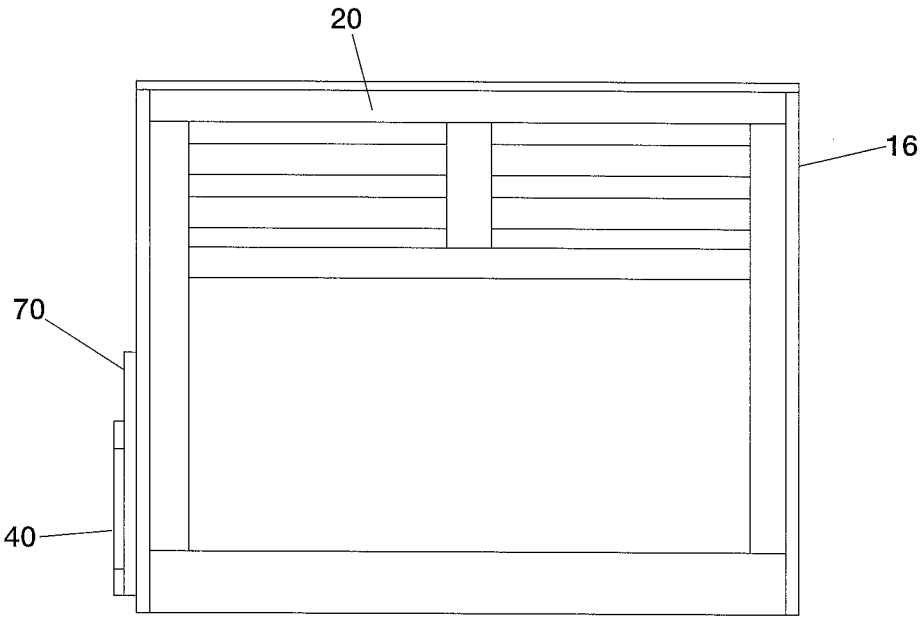
FIG. 4A is a left side view of the bed in a closed configuration, the opposite side being a mirror image thereof.

In operation, bed 10 provides the opportunity of having multiple configurations. In one configuration, bed 10 is in a sofa configuration that may be used for either sitting or lying down. As seen in FIGS. 1A and 4A, the movable bed support assembly 70 and storage compartment 40 remain with stationary bed support assembly 12.

Figure 4B:
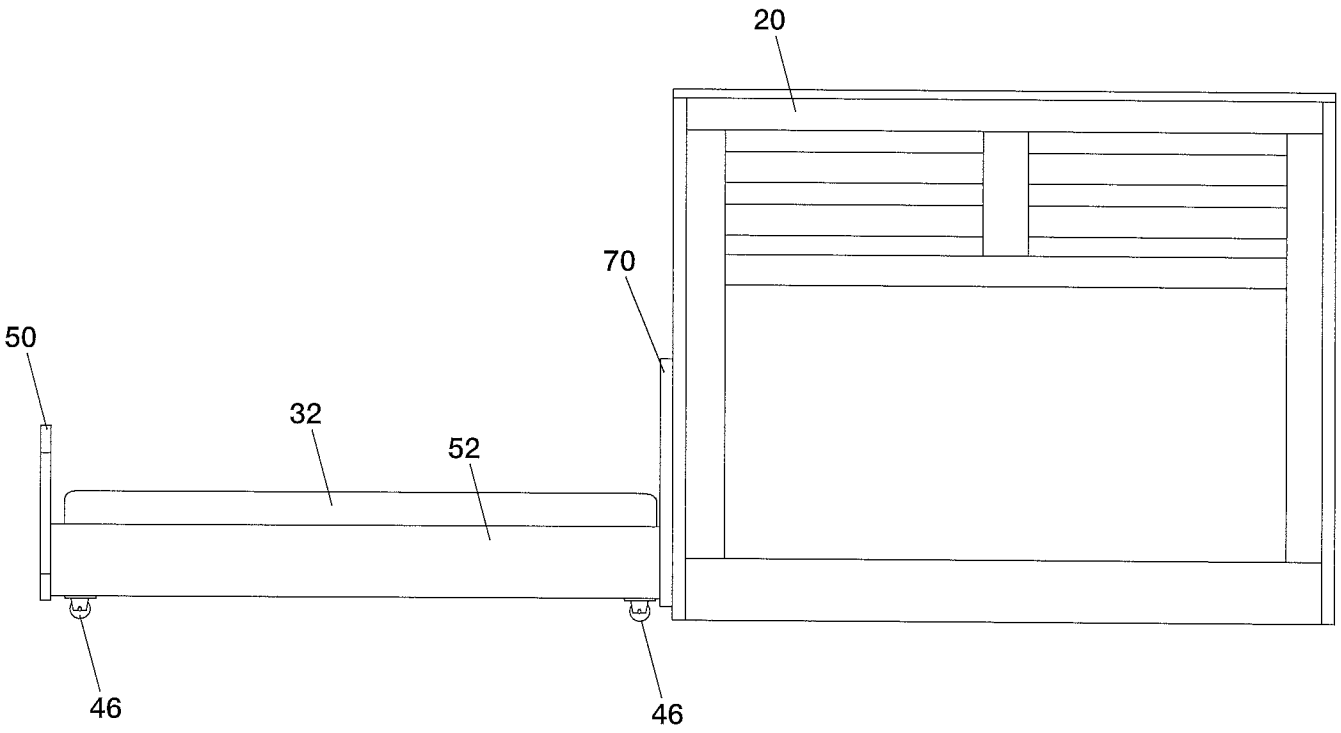
FIG. 4B is a left side view of the bed shown in FIG. 4A with the trundle extended with a mattress, the opposite side being a mirror image thereof.

In another configuration, as seen in FIGS. 1B and 4B, the storage compartment 40 is adapted for use as a trundle bed that may be extended out while bed 10 is in a sofa configuration.

Figure 4C:
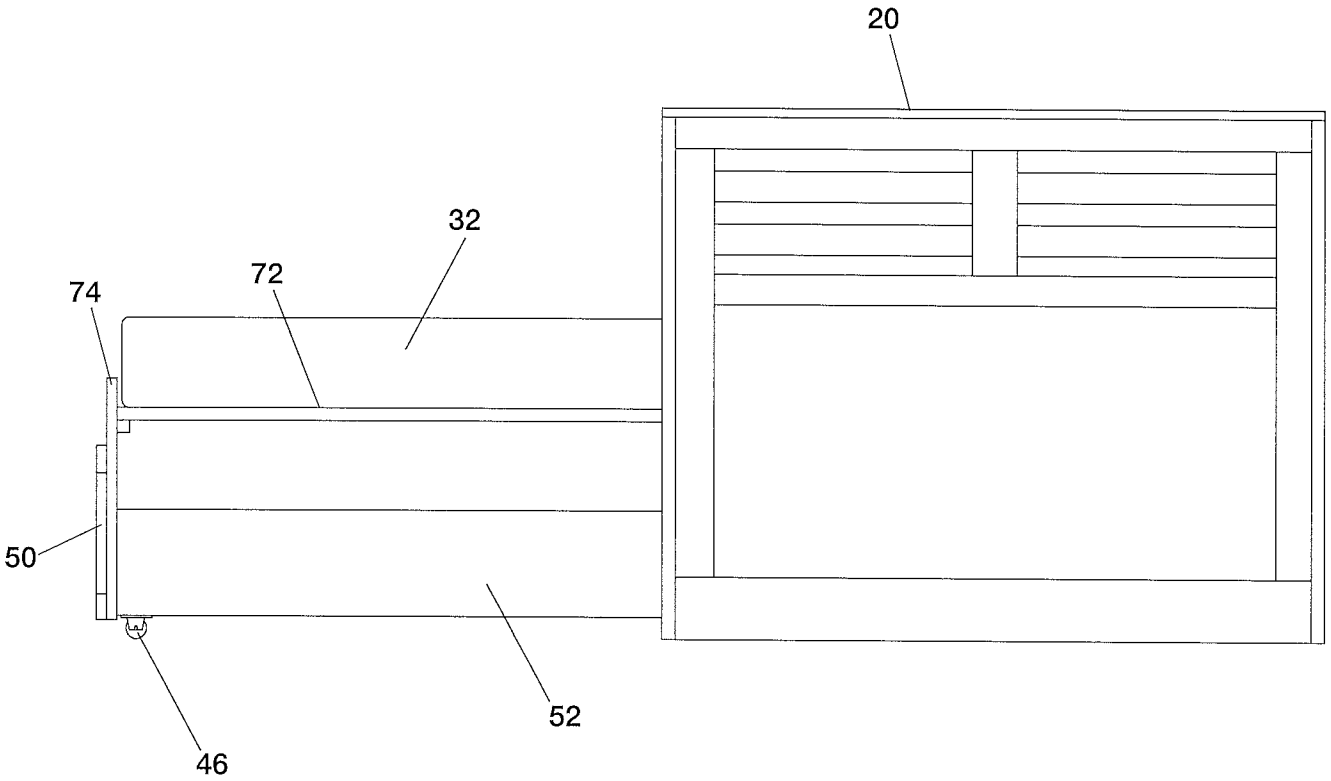
FIG. 4C is a left side view of the bed shown in FIG. 4A with the trundle and slats extended forming a king size bed with a mattress, the opposite side being a mirror image thereof.

In still another configuration, as seen in FIGS. 1C and 4C, the movable bed support assembly may be extended out as a king size bed when the mattress stored in storage compartment 40 is placed on top of it. Storage compartment 40 may be extended out with movable bed support assembly in this configuration. Alternatively, movable bed support assembly 70 may be extended out to form a king size bed using a non-stored mattress (e.g. removing a top mattress from a pair of stacked mattresses on stationary bed support assembly 12 when the storage compartment 40 is used for other items, like toys).

Figure 7:
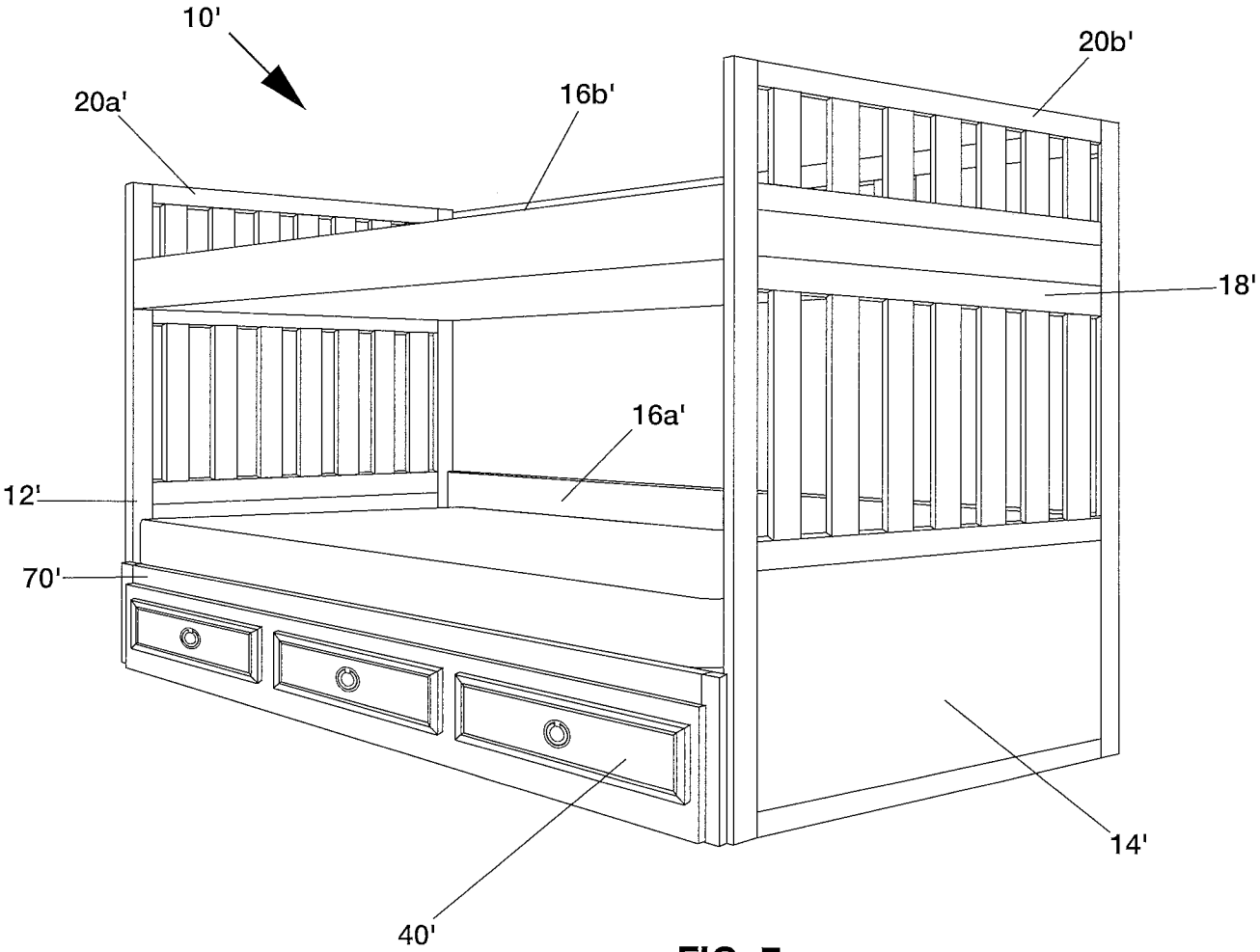
FIG. 7 is a perspective view of one embodiment of a bunk bed in a closed configuration constructed according to the present inventions.

The storage compartment and movable bed support assembly may be used for other convertible furniture assemblies. For example, FIG. 7 depicts a bed 10' in a bunk bed configuration, wherein the bed 10' includes a stationary bed support assembly 12', a movable bed support assembly 70', and a storage compartment 40'. The stationary bed support assembly 12' includes a stationary bed frame 14', a back rest 16' and a pair of side arms 20*a*' and 20*b*'. The side anus 20*a*' and 20*b*' extend up and further include a bunk bed support assembly 18' to support a second mattress. Back rest 16*a*' may be attached to a portion of stationary bed support assembly 12' to secure a first mattress, and back rest 16*b*' may be attached to the bunk bed support assembly 18' to secure a second mattress.

Figure 8:
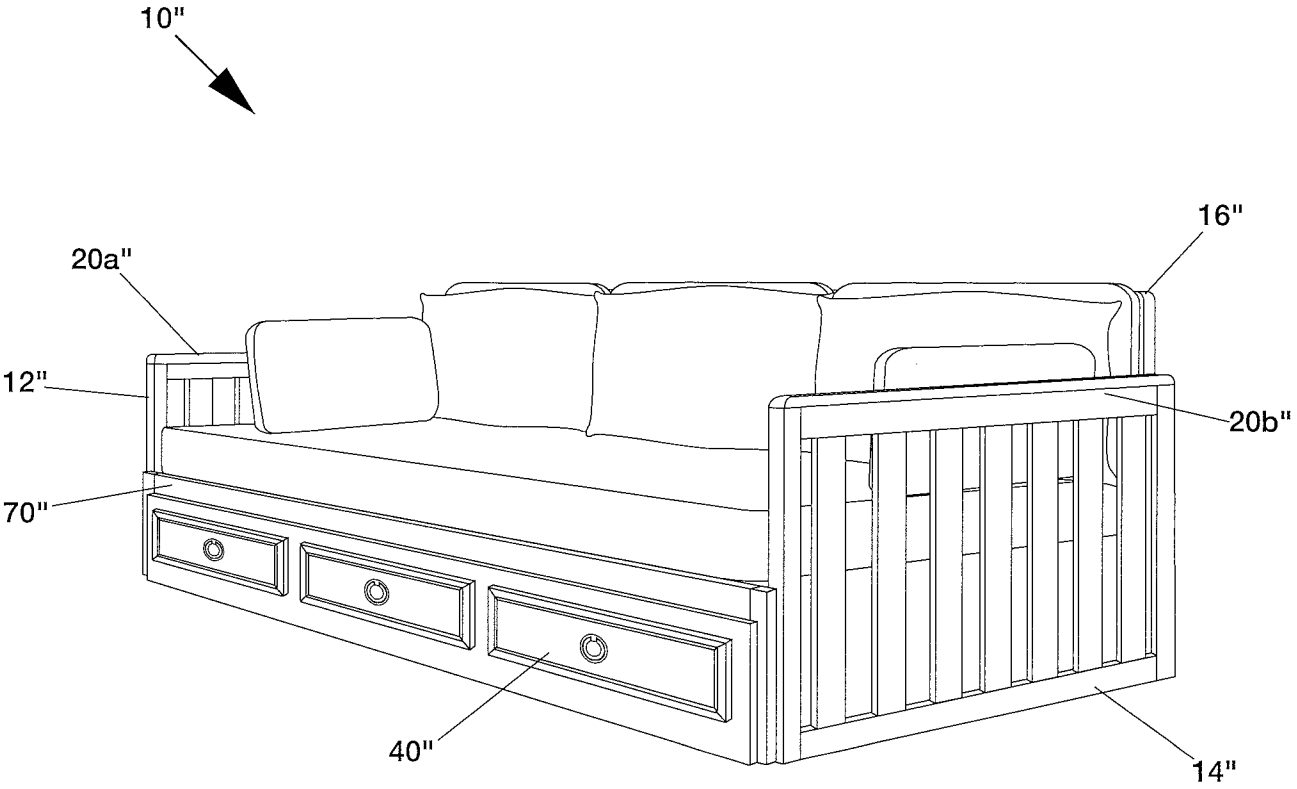
FIG. 8 is a perspective view of one embodiment of a sofa bed in a closed configuration constructed according to the present inventions.

FIG. 8 provides another example with a sofa 10" having a stationary bed support assembly 12", a movable bed support assembly 70", and a storage compartment 40". The stationary bed support assembly 12" includes a stationary bed frame 14", a back rest 16" and a pair of side arms 20*a*" and 20*b*". Back rest 16" is attached to a portion of stationary bed support assembly 12" to support a user's back.

Certain modifications and improvements will occur to those skilled in the art upon a reading of the foregoing description. By way of example, movable bed support assembly may comprise two separate frames having its own sets of interlocking slats supported by front and back rails. Multiple frames for movable bed support assembly may be useful for providing additional presets to accommodate a third mattress or second mattresses of various sizes. It should be understood that all such modifications and improvements have been deleted herein for the sake of conciseness and readability but are properly within the scope of the following claims.

We claim:

1. A bed convertible between a sofa configuration and a bed configuration, said bed comprising:

(a) a stationary bed support assembly having a stationary bed frame, a back rail, a front rail, a plurality of slats adapted to support a mattress, and at least one pair of legs attached to the front portion of the frame of said stationary bed support assembly adapted to elevate and support said stationary bed frame; and (b) a movable bed support assembly having a movable bed frame, a back rail, a front rail, a plurality of slats adapted to support a mattress, at least one pair of front legs attached to the front portion of the frame of said movable bed support assembly and at least one pair of back legs attached to the back portion of the frame of said movable bed support assembly adapted to elevate and support said movable bed frame, wherein said slats of said movable bed support assembly overlap said front rail of said stationary bed support assembly and interlock with said slats of said stationary bed support assembly, whereby said bed is in the sofa configuration when said front rail of said movable bed support assembly abuts said front rail of said stationary bed support assembly and said at least one pair of front legs of said movable bed support assembly abuts said at least one pair of legs of said stationary bed support assembly, and whereby said bed is in the bed configuration when said back rail of said movable bed support assembly abuts said front rail of said stationary bed support assembly and said at least one pair of back legs of said movable bed support assembly abuts said at least one pair of legs of said stationary bed support assembly.

2. The bed according to claim 1 further including a backrest attached to said back rail of said stationary bed support assembly, whereby said backrest is adapted to support a user's back when said bed is in said sofa configuration.

3. The bed according to claim 2 further including at least one side arm attached to said frame of said stationary bed support assembly, whereby said at least one side arm is adapted to support a user's arm when said bed is in said sofa configuration and whereby said at least one side arm is adapted as a head board when said bed is in said bed configuration.

4. The bed according to claim 3, wherein said bed includes a pair of side arms attached to said frame of said stationary bed support assembly, whereby said pair of side arms are adapted to support users' arms when said bed is in said sofa configuration and whereby said pair of side arms are adapted as a head board and footboard when said bed is in said bed configuration.

5. The bed according to claim 1 further including a mattress positioned on top of said stationary bed support assembly adapted to provide a surface for a user to sit and lay on.

6. The bed according to claim 5, wherein said mattress is a pair of two stacked mattresses adapted to be adjacently placed when said bed is in said bed configuration.

7. The bed according to claim 6, wherein said pair of stacked mattresses are twin size and adapted to form a king size bed when adjacently placed.

8. A bed convertible between a sofa configuration and a bed configuration, said bed comprising:

(a) a stationary bed support assembly having a stationary bed frame, a back rail, a front rail, a plurality of slats adapted to support a mattress, and at least one pair of legs attached to the front portion of the frame of said stationary bed support assembly adapted to elevate and support said stationary bed frame;

(b) a movable bed support assembly having a movable bed frame, a back rail, a front rail, a plurality of slats adapted to support a mattress, at least one pair of front legs attached to the front portion of the frame of said movable bed support assembly and at least one pair of back legs attached to the back portion of the frame of said movable bed support assembly adapted to elevate and support said movable bed frame; and (c) a storage compartment located underneath said stationary bed support assembly and said movable bed support assembly, wherein said slats of said movable bed support assembly overlap said front rail of said stationary bed support assembly and interlock with said slats of said stationary bed support assembly, whereby said bed is in the sofa configuration when said front rail of said movable bed support assembly abuts said front rail of said stationary bed support assembly and said at least one pair of front legs of said movable bed support assembly abuts said at least one pair of legs of said stationary bed support assembly, and whereby said bed is in the bed configuration when said back rail of said movable bed support assembly abuts said front rail of said stationary bed support assembly and said at least one pair of back legs of said movable bed support assembly abuts said at least one pair of legs of said stationary bed support assembly.

9. The bed according to claim 8, wherein the front rail of said stationary bed support assembly is scalloped along its top edge for enabling said slats of said movable bed support assembly to slide forward and backward as said bed switches between said configurations.

10. The bed according to claim 9 further including a stop adapted to prevent said movable bed support assembly from extending past said stationary bed support assembly.

11. The bed according to claim 10, wherein said front rail of said stationary bed support assembly forms said stop.

12. The bed according to claim 8, wherein said slats of said stationary bed support assembly and said slats of said movable bed support assembly are substantially the same length.

13. The bed according to claim 8, wherein said storage compartment includes a front, a pair of sides and a bottom.

14. The bed according to claim 13 further including at least one pair of wheels attached to said bottom of said storage compartment adapted to facilitate pulling said storage compartment from underneath said stationary bed support assembly.

15. The bed according to claim 13 further including handles on said front of said storage compartment to facilitate pulling said storage compartment from underneath said stationary bed support assembly.

16. The bed according to claim 8, wherein said storage compartment is adapted to receive and store a mattress.

17. The bed according to claim 16, wherein said storage compartment forms a trundle bed when said storage compartment is pulled from underneath said stationary bed support assembly and said bed is in said sofa configuration.

18. The bed according to claim 16, wherein a first mattress stored in said storage compartment is placed onto said movable bed support assembly when said bed is in said bed configuration.

19. The bed according to claim 18, wherein a second mattress is on said stationary bed support assembly when said bed is in said sofa configuration and forms a pair of mattresses with said first mattress on said movable bed support assembly when said bed is in said bed configuration.

20. The bed according to claim 19, wherein said pair of mattresses are twin size and adapted to form a king size bed.

21. A bed convertible between a sofa configuration and a bed configuration, said bed comprising:

(a) a stationary bed support assembly having a stationary bed frame, a back rail, a front rail, a plurality of slats adapted to support a mattress, and at least one pair of legs attached to the front portion of the frame of said stationary bed support assembly adapted to elevate and support said stationary bed frame;

(b) a movable bed support assembly having a movable bed frame, a back rail, a front rail, a plurality of slats adapted to support a mattress, at least one pair of front legs attached to the front portion of the frame of said movable bed support assembly and at least one pair of back legs attached to the back portion of the frame of said movable bed support assembly adapted to elevate and support said movable bed frame;

(c) a storage compartment located underneath said stationary bed support assembly and said movable bed support assembly; and (d) a back rest attached to said back rail of said stationary bed support assembly, whereby said back rest is adapted to support a user's back when said bed is in said sofa configuration, wherein said slats of said movable bed support assembly overlap said front rail of said stationary bed support assembly and interlock with said slats of said stationary bed support assembly, whereby said bed is in the sofa configuration when said front rail of said movable bed support assembly abuts said front rail of said stationary bed support assembly and said at least one pair of front legs of said movable bed support assembly abuts said at least one pair of legs of said stationary bed support assembly, and whereby said bed is in the bed configuration when said back rail of said movable bed support assembly abuts said front rail of said stationary bed support assembly and said at least one pair of back legs of said movable bed support assembly abuts said at least one pair of legs of said stationary bed support assembly.

22. The bed according to claim 21 further including at least one side arm attached to said frame of said stationary bed support assembly, whereby said at least one side arm is adapted to support a user's atm when said bed is in said sofa configuration and whereby said at least one side arm is adapted as a head board when said bed is in said bed configuration.

23. The bed according to claim 22, wherein said bed includes a pair of side arms attached to said frame of said stationary bed support assembly, whereby said pair of side arms are adapted to support users' arms when said bed is in said sofa configuration and whereby said pair of side arms are adapted as a head board and footboard when said bed is in said bed configuration.

24. The bed according to claim 21 further including a mattress positioned on top of said stationary bed support assembly adapted to provide a surface for a user to sit and lay on.

25. The bed according to claim 24, wherein said mattress is a pair of two stacked mattresses adapted to be adjacently placed when said bed is in said bed configuration.

26. The bed according to claim 25, wherein said pair of stacked mattresses are twin size and adapted to form a king size bed when adjacently placed.

27. The bed according to claim 21, wherein the front rail of said stationary bed support assembly is scalloped along its top edge for enabling said slats of said movable bed support assembly to slide forward and backward as said bed switches between said configurations.

28. The bed according to claim 27 further including a stop adapted to prevent said movable bed support assembly from extending past said stationary bed support assembly.

29. The bed according to claim 28, wherein said front rail of said stationary bed support assembly forms said stop.

30. The bed according to claim 21, wherein said slats of said stationary bed support assembly and said slats of said movable bed support assembly are substantially the same length.

31. The bed according to claim 21, wherein said storage compartment includes a front, a pair of sides and a bottom.

32. The bed according to claim 31 further including at least one pair of wheels attached to said bottom of said storage compartment adapted to facilitate pulling said storage compartment from underneath said stationary bed support assembly.

33. The bed according to claim 31 further including handles on said front of said storage compartment to facilitate pulling said storage compartment from underneath said stationary bed support assembly.

34. The bed according to claim 21, wherein said storage compartment is adapted to receive and store a mattress.

35. The bed according to claim 34, wherein said storage compartment forms a trundle bed when said storage compartment is pulled from underneath said stationary bed support assembly and said bed is in said sofa configuration.

36. The bed according to claim 34, wherein a first mattress stored in said storage compartment is placed onto said movable bed support assembly when said bed is in said bed configuration.

37. The bed according to claim 36, wherein a second mattress is on said stationary bed support assembly when said bed is in said sofa configuration and forms a pair of mattresses with said first mattress on said movable bed support assembly when said bed is in said bed configuration.

38. The bed according to claim 37, wherein said pair of mattresses are twin size and adapted to form a king size bed.

* * * * *